8-110 SR
FIP8309 XR 4,102,642

United States Patent [19]
Banks

[11] 4,102,642
[45] Jul. 25, 1978

[54] TREATMENT OF FABRIC COMPRISING COTTON OR KERATINOUS FIBERS FOR SHRINK RESISTANCE

[76] Inventor: John B. Banks, 4 Page St., Augusta, Me. 04330

[21] Appl. No.: 681,902

[22] Filed: Apr. 30, 1976

[51] Int. Cl.[2] ..... D06M 1/02; D06M 3/04
[52] U.S. Cl. ..... 8/125; 8/110; 8/127.5; 8/128 R; 8/127.51
[58] Field of Search ..... 8/128 R, 127.5, 127.51, 8/125, 110

[56] References Cited

U.S. PATENT DOCUMENTS

| | | | |
|---|---|---|---|
| 3,466,136 | 9/1969 | Wasley et al. | 8/128 R |
| 3,477,805 | 11/1969 | Gagarine et al. | 8/128 R |
| 3,537,809 | 12/1964 | Cednäs et al. | 8/128 R |

FOREIGN PATENT DOCUMENTS

| | | | |
|---|---|---|---|
| 537,883 | 2/1957 | Canada | 8/128 R |
| 443,359 | 2/1936 | United Kingdom | 8/128 |
| 501,292 | 2/1939 | United Kingdom | 8/128 |

OTHER PUBLICATIONS

Cook; J. G., *Handbook of Textile Fibers*, Merrow Publ. Co. Waterford, 1964, p. 71.
Begen; W. von., Wool Handbook, vol. II, Inter--Science, N.Y., 1970, pp. 936–937.

*Primary Examiner*—Joseph L. Schofer
*Assistant Examiner*—Maria S. Tungol
*Attorney, Agent, or Firm*—Robert L. Goldberg; David G. Conlin

[57] ABSTRACT

A fabric comprising cotton and/or keratinous fibers, e.g., wool, is treated to impart wash and wear characteristics including dimensional stability by contact of said fabric with hot, aqueous, relatively concentrated solution of a sulfite for a time sufficient to impart said wash and wear characteristics to said fabric. A preferred sulfite is aluminum sulfite and preferred treatment conditions comprise contact of the fabric with a boiling solution containing from about 10% to 20% by weight of the sulfite for a time of from 5 to 15 minutes. Preferably the solution also contains sodium carbonate in an amount of about 1% to 50% by weight, preferably from about 5% to about 20% by weight, based on the amount of sulfite.

6 Claims, No Drawings

TREATMENT OF FABRIC COMPRISING COTTON OR KERATINOUS FIBERS FOR SHRINK RESISTANCE

BACKGROUND OF THE INVENTION

This invention relates to the chemical modification of textiles and fibers and more particularly, the chemical modification of proteinaceous textiles of fibers by contact with an aqueous solution of a sulfite to impart wash and wear characteristics.

Much of the material in this application was also presented in U.S. Application Ser. No. 61,183, filed Aug. 5, 1970, now abandoned, and in Application Ser. No. 481,105, filed June 20, 1974, now abandoned.

Fabrics consisting wholly or in part of wool have long been known to undergo undesirable changes in physical characteristics during washing, including excessive wrinkling and a pronounced tendency to felt or shrink. Therefore, a method has long been sought to provide an effective process for preventing or minimizing this wrinkling and shrinking of wool. Numerous solutions to this problem have been advanced largely in the nature of chemical treatment which may be classified as halogenation, oxidation, reduction, alkaline, enzyme, or resin treatments. However, with a treatment of wool or other keratinous fibers or cotton to reduce wrinkling and shrinking, it is also necessary that other changes do not occur in the fibers so as to result in a diminution of the hand, appearance, color, strength, and other desirable properties of the original wool or wool containing material.

In connection with the above processes, it is common practice to treat a woolen fabric, first with a solution of an oxidizing agent and then with a solution of a reducing agent. Typical reducing agents include aqueous solutions of various sulfites and consequently, sulfites are in common usage in procedures for imparting wash and wear characteristics to woolen fabrics. For example, in U.S. Pat. No. 3,097,913, a process is disclosed comprising treating a woolen fabric with an oxidizing solution maintained at about 50° F. to 100° F. containing from about 0.1 to 0.4 percent by weight of oxidizers selected from peracetic acid and mixtures of peracetic and potassium permanganate at a pH less than 7 and thereafter treating such fabric with a reducing solution maintained at about 65° F. to 140° F. having a concentration of from about 0.5 to 5.0% by weight of an alkaline metal or alkaline earth metal salt of a sulfite or bisulfite. The period of contact with the oxidizing solution typically ranges from about 10 to 30 seconds and the contact with the reducing solution typically ranges from about 10 seconds to 45 minutes.

In U.S. Pat. No. 2,739,034, a process for treating wool fabrics to prevent shrinkage is disclosed comprising treatment of the wool fabric with an oxidizing solution of permonosulfuric acid at a pH less than 8 followed by contact with a reducing solution consisting of normal, acidic or basic salts of sulphurous acid which salts would include sulfites. The teaching in said patent is that if concentrated sulfite solutions are used, contact time and solution temperature are low. If dilute sulfite solutions are used, contact time and temperature may be increased.

As incidental disclosure in the aforesaid U.S. Pat. No. 2,739,034, there is disclosed the use of zinc sulfite alone as a treatment for wool. In this respect, a wool fabric was rinsed with water and treated at 25° C. for 30 minutes in a bath containing 0.5% zinc sulfite. It is reported that this treatment is ineffective inasmuch as the area shrinkage is 22%.

SUMMARY OF THE INVENTION

The present invention is predicated upon the discovery that fabrics such as cotton or wool, mohair and the like can be treated to impart wash and wear characteristics including dimensional stability by contact with an aqueous solution of a sulfite under carefully coordinated processing conditions of contact time, solution temperature and sulfite concentration without the necessity for resort to an additional treatment solution such as the above-described first treatment with a solution of an oxidizing agent.

The processing conditions required in accordance with the invention can be termed "more severe" than in the prior art because, relative to the prior art methods, solution concentration in sulfite is high, contact time with the solution is prolonged and solution temperature is high. It should be noted that in the prior art, one of the above processing conditions may overlap with one of the conditions of the process described herein. However, the overall processing conditions would not be considered severe in accordance with the term as used herein because other of the processing conditions are altered as a means of compensation. For example, the process of the subject application preferably uses a boiling solution. A boiling sulfite solution may be disclosed in the prior art. However, where such a boiling solution is used, the sulfite concentration is typically maintained low and/or a short contact time of the fabric with the solution is used.

In a preferred embodiment of the invention, the sulfite used is aluminum sulfite and treatment conditions comprise contact of the fabric with a boiling solution containing from about 10 to 20% by weight of the aluminum sulfite for a time of from 5 to 15 minutes.

In the most preferred embodiment the treatment solution contains a soluble alkali or alkaline earth metal carbonate in an amount of from about 1% to about 50% by weight, preferably from about 5% to about 20% by weight based on the amount of sulfite in the solution. Sodium carbonate is presently most preferred.

Typical sulfites suitable for purposes of the present invention include sodium sulfite, lithium sulfite, potassium sulfite, aluminum sulfite, barium sulfite, calcium sulfite, magnesium sulfite, manganese sulfite, strontium sulfite and zinc sulfite. Other sulfites will be apparent to those skilled in the art. Of the above, aluminum sulfite is greatly preferred as the results achieved using this material are substantially superior to the use of other sulfites. In this respect, using aluminum sulfite, under preferred processing conditions, area shrinkage may be maintained below 2.0%.

The process of the invention is relatively simple and comprises contacting a fabric with a hot, aqueous sulfite solution having a relatively high concentration of sulfite for a prolonged period of time. Solution concentration in sulfite, solution temperature and contact time are all inter-related variables and altering one will in most cases influence the others. Thus, for example, if contact time is excessively long such as for a period of 1 hour, then sulfite concentration may be maintained relatively low such as 5% by weight. Alternatively, if the solution is highly concentrated in sulfite such as having a sulfite compound concentration between about 20 and 25% by weight, then contact time may be shortened such as to between about 5 and 10 minutes or alternatively, solution temperature may be somewhat reduced. In general, the goal of the invention is to regulate conditions so that total area shrinkage is no more than 4.0%.

For commercial operation of the process, the concentration of the sulfite compound in solution should be between about 5 and 35% by weight, preferably between about 10 and 25% by weight, and most preferably about 20% by weight. The solution temperature may vary between about 150° F. and the boiling point of the solution, preferably between about 180° F. and the boiling point of the solution, and most preferably at about the boiling point of the solution. Contact of the fabric with the solution may vary between about 2 minutes and an hour, preferably 5 to 20 minutes, and most preferably about 12 minutes. A preferred set of processing conditions in accordance with the invention would comprise contact of a woolen fabric with an aluminum sulfite solution maintained between about 180° F. and the boiling point of the solution and containing from about 10 to 25% by weight aluminum sulfite for a period of from 2 to 20 minutes.

The method of contacting the wool fabric with the treating solution is not critical and prior art procedures such as immersion or spraying may be employed. Because of the relatively severe conditions employed, immersion is the most preferred method of contact.

As with prior art procedures, following treatment as described above, a water rinse should be employed. Since the treatment in accordance with this invention employs solutions which are somewhat more acidic than the solutions of the prior art, a sequence of rinsing operations are desirable, or alternatively, one rinsing operation using water to which an alkali such as sodium hydroxide in low concentration has been added is desirable.

It is important that the treated cloth be dried well after treatment with the sulfite solution before washing. Once dried, the cloth seems to set so that the shrinkage is greatly reduced. Thereafter, no appreciable adverse effect is observed on the prevention of wrinkles and shrinkage in accordance with the invention despite numerous washings in hot tap water, e.g. at 130° to 140° F. or higher.

In accordance with conventional procedures, the process of rendering the fabric comprising the keratinous or cotton fibers can be made continuous.

The present invention will be more completely understood by reference to the following examples.

EXAMPLE 1

A solution is prepared comprising 3 ounces of aluminum sulfite and 3/16 ounce of sodium carbonate, dissolved in 1 gallon of water. The solution is heated to boiling for 15 minutes, and a 16 ounce wool fabric is immersed therein for a period of 4 minutes. Thereafter, the fabric is removed and dried thoroughly before washing. No visible alteration of the fabric is observed. To determine dimensional stability, the fabric is twice laundered and then boiled in hot water for a period of about 5 minutes. Following drying, the area of the fabric is measured. It is found that area shrinkage from original dimensions is less than 1%.

EXAMPLE 2

Using the fabric of Example 1 and following substantially the same procedure, a cloth was treated to determine whether or not the treated fabric would meet the requirements of Department of Army Specification MIL-C-11065D(GL). The following results were obtained:

| Test | ASTM Method or other | Results | Specificaton |
|---|---|---|---|
| Colorfastness (light) | 5660 | Satisfactory | Equal to Standard |
| Colorfastness (wet-dryclean) | 5622 | Satisfactory | Equal to Standard |
| Colorfastness (perspiration) | 5680 | Satisfactory | Equal to Standard |
| Colorfastness (crocking) | 5651 | Satisfactory | Equal to Standard |
| Colorfastness (laundering) | 5614 | Satisfactory | Equal to Standard |
| Change in shade | Spectro-photo-meter | Satisfactory | Equal to Standard |
| Weight | 5041 | | 16 oz. min/56" yd |
| treated | | 17.3 oz/56" yd | |
| control | | 16.3 oz/56" yd | |
| Breaking strength | 5100 | | 50 × 40 lb |
| treated | | 78 × 60 lb | |
| control | | 72 × 60 lb | |
| Shrinkage (relaxation) | 5558 | | 50% × 5.0% |
| trated | | 6.1% × 0.4% | |
| control | | 5.1% × 1.7% | |
| Shrinkage (in felting) | 5554 | | 5.0% × 3.0% |
| treated | | 2.2% × 0.2% | |
| control | | 4.5% × 0.4% | |
| pH (acidity) | 2811 | | 4.0–8.0 |
| trated | | 3.45 | |
| control | | 5.65 | |

From above, it can be seen that the treated sample met the specifications in every manner except with regard to pH. However, upon subsequent treatments in a similar fashion, but with more prolonged rinsing or with the addition of alkali to the rinse water, pH fell within the specified range.

This Example also illustrates that treatment in accordance with the subject invention, even though under severe conditions, does not adversely affect the fabric in any appreciable manner as is encountered with prior art methods for preventing shrinkage.

In addition to dimensional control, there are other secondary benefits to the process of this invention. For example, there is some indication that treatment in accordance with the present invention provides improvements in other properties of the fabric including some improvement in flame retardancy, strengthening of the fabric, possible elimination of a fulling treatment, and possible elimination for the need to blend wool or cotton fibers with synthetic fibers to accomplish some of the foregoing improvements.

The manner in which the processing of the wool in accordance with the invention causes dimensional stability is not fully understood. The prevention of felting shrinkage by the common methods and those reported in the current literature, employing various chlorinating agents, oxidizing chemicals and resin applications has been attributed to the effect on the elastic properties of wool as well as the modification of the fiber surface, and in the case of some resins, to the so-called "spot-welding" of the fibers or fiber assemblies to achieve a more rigid structure. Changes in the elastic properties have been mainly shown to be caused by the modification of the very reactive cystine linkages as well as modification of other amino acid groups including possibly hydrogen bonds and the salt linkages. Modification of the fabric in accordance with this invention in all probability involves some of the above reactions, but the exact nature of the reaction and the chemical structure of the modified wool after being treated in accordance with the invention is not fully understood.

As indicated above, it is most preferred to include from about 1% to about 50%, preferably from about 5% to about 20%, of a soluble carbonate salt, based on the weight percentage of sulfite present in the treatment solution. It has surprisingly been found that this inclusion enhances the shrink-preventive properties of the sulfite, in most cases resulting in wool fabric which exhibits essentially no shrinkage. At the same time, such addition increases the resistance of the fabric to moths and to flames, and increases the fabric's strength. Soluble carbonates are suitable, particularly the alkali and alkaline earth carbonates, with sodium carbonate being most preferred. An illustrative embodiment showing such a formulation is given in Example 3.

EXAMPLE 3

A solution is prepared comprising 8 oz. of iron-free aluminum sulfate and 8/32 oz. of sal soda (sodium/carbonate) in one gallon of water. The solution should be brought to a boil for 15 minutes, and wool or cotton fabric should be treated in the 200° F. solution for about 4 minutes.

While illustrative embodiments of the invention have been described hereinbefore with particularity, it will be understood that various other modifications will be apparent to and can readily be made by those skilled in the art without departing from the scope and spirit of the invention. For example, while it has earlier been stated that the use of a sulfite solution results in shrinkage control without the use of other solutions, it should be understood that other solutions can be used in conjunction with the sulfite solution such as the oxidizing solutions of the prior art. However, when such an oxidizing solution is used with a sulfite solution, little or no further improvement in shrinkage control is realized. In addition, the invention contemplated any fabric comprising cotton or keratinous fibers such as wool, mohair and the like. Moreover, these fibers may be admixed with each other and/or with various synthetics as is known in the art.

I claim:

1. A process for imparting wash and wear characteristics including dimensional stability to a fabric consisting essentially of cotton fiber comprising the steps of contacting said fabric with a solution consisting essentially of a metal sulfite selected from the group of aluminum sulfite, sodium sulfite, lithium sulfite, potassium sulfite, barium sulfite, calcium sulfite, magnesium sulfite, manganese sulfite, strontium sulfite and zinc sulfite, said metal sulfite being present in an amount of about 5% to 35% by weight, and 1 to 50 percent by weight of a soluble carbonate, selected from the group of alkali and alkaline earth carbonates, based on the weight of sulfite in said solution, said solution having a temperature of from 150° F. to its boiling point, drying the fabric thoroughly and thereafter washing the fabric, said fabric being contacted with said solution for a sufficient time to produce a fabric of dimensional stability such that the maximum shrinkage during laundering does not exceed 4 percent.

2. The process of claim 1, wherein said fabric is contacted with a solution containing at least 5% by weight of a aluminum sulfite for a period of at least 2 minutes, which solution is maintained at a temperature of at least 160° F.

3. The process of claim 1 where the time of contact of the fabric with the solution varies between about 2 minutes and 1 hour.

4. The process of claim 1 where the concentration of the metal sulfite in the solution is between about 10 and 25%, the temperature of the solution is maintained between about 200° F. and the boiling point of the solution and the time of contact of the fabric with the solution is between about 5 and 20 minutes.

5. The process of claim 1, wherein the concentration of the metal sulfite in solution is about 20%, the solution is maintained at its boiling point, and the time of contact of the fabric with the solution is about 4 minutes.

6. The process of claim 1, wherein said soluble carbonate is present in an amount of from 5% to 20% by weight, based on the amount of sulfite in said solution.

* * * * *